US010894412B2

(12) United States Patent
Kagata et al.

(10) Patent No.: US 10,894,412 B2
(45) Date of Patent: Jan. 19, 2021

(54) INK JET RECORDING APPARATUS

(71) Applicant: Seiko Epson Corporation, Tokyo (JP)

(72) Inventors: Takayoshi Kagata, Shiojiri (JP); Hiroshi Fukumoto, Shiojiri (JP); Takeshi Yano, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/550,674

(22) Filed: Aug. 26, 2019

(65) Prior Publication Data

US 2020/0061997 A1 Feb. 27, 2020

(30) Foreign Application Priority Data

Aug. 27, 2018 (JP) ..... 2018-158122

(51) Int. Cl.
*B41J 2/165* (2006.01)
*B41J 2/055* (2006.01)
*B41J 2/045* (2006.01)

(52) U.S. Cl.
CPC ..... *B41J 2/16505* (2013.01); *B41J 2/0451* (2013.01); *B41J 2/055* (2013.01); *B41J 2/16526* (2013.01)

(58) Field of Classification Search
CPC ..... B41J 2/16505; B41J 2/16526; B41J 2/16511; B41J 2/165; B41J 2/16547; B41J 2/04551; B41J 2/055
See application file for complete search history.

(56) References Cited

U.S. PATENT DOCUMENTS 8,883,292 B2 * 11/2014 Kagata et al. ..... C09D 11/38
2005/0093947 A1 5/2005 Maekawa et al.
2016/0152030 A1 * 6/2016 Nawano et al. ..... B41J 2/16523

FOREIGN PATENT DOCUMENTS

JP 2003-334961 A 11/2003
JP 2004-107647 A 4/2004
JP 2016-028145 A 2/2016
JP 2018-002757 A 1/2018

* cited by examiner

*Primary Examiner* — Juanita D Jackson
(74) *Attorney, Agent, or Firm* — Harness, Dickey & Pierce, P.L.C.

(57) ABSTRACT

An ink jet recording apparatus includes a discharge head including a nozzle discharging ink to a recording medium and a cap capable of covering the nozzle of the discharge head. The ink contains water, a colorant, and an organic compound which is solid at 25.0° C. and which has an octanol/water distribution coefficient of 0.0 or less. The cap includes no ink absorber.

9 Claims, 5 Drawing Sheets

INK JET RECORDING APPARATUS

The present application is based on, and claims priority from, JP Application Serial Number 2018-158122, filed Aug. 27, 2018, the disclosure of which is hereby incorporated by reference herein in its entirety.

BACKGROUND

1. Technical Field

The present disclosure relates to an ink jet recording apparatus.

2. Related Art

Ink jet recording apparatuses are those that make a record in such a manner that ink droplets are discharged from fine nozzles and are applied to a recording medium. The ink jet recording apparatuses have a feature that a high-resolution, high-quality image can be recorded at high speed. In the ink jet recording apparatuses, there are numerous investigation factors such as recording stability and the quality of an obtained image. Not only the improvement in performance of the ink jet recording apparatuses is being investigated but also inks used are increasingly investigated.

An ink jet recording apparatus may possibly include a cap for sealing (capping) nozzle holes of a discharge head to suppress the clogging of the nozzle holes in the case of stopping a recording operation. When the ink jet recording apparatus includes the cap, an inner bottom section of the cap is equipped with an ink absorber made of a porous material. This allows the inside of the cap to be moisturized with the porous material that has absorbed ink.

In consideration of the fact that, in the case of capping using such a cap, nozzle clogging occurs because ink in nozzles is dehydrated by ink absorbed by a porous member and therefore solidifies, JP-A-2003-334961 proposes an ink jet recording apparatus including no ink absorber in a cap.

However, even when no ink absorber is placed in a cap as described in JP-A-2003-334961, nozzle clogging during capping has not been capable of being suppressed in some cases.

SUMMARY

An ink jet recording apparatus according to an aspect of the present disclosure includes a discharge head including a nozzle discharging ink to a recording medium and a cap capable of covering the nozzle of the discharge head. The ink contains water, a colorant, and an organic compound which is solid at 25.0° C. and which has an octanol/water distribution coefficient of 0.0 or less. The cap includes no ink absorber.

In the ink jet recording apparatus, an image may be formed on the recording medium in such a manner that the discharge head is reciprocated in a main scanning direction and the recording medium is conveyed in a sub-scanning direction crossing the main scanning direction and the area that the recording medium is conveyed per unit time may be 15.0 $m^2$/h or more.

The ink jet recording apparatus may further include a platen. A surface of the platen may face a nozzle-formed surface provided with the nozzle. The recording medium may be conveyed between the platen surface and the nozzle-formed surface. The distance between the platen surface and the nozzle-formed surface may be 1.5 mm or more.

In the ink jet recording apparatus, the organic compound may be selected from trimethylolpropane, polyvinylpyrrolidone, urea, and thiourea.

In the ink jet recording apparatus, the ink may further contain a humectant.

In the ink jet recording apparatus, the content of the organic compound in the ink may be 3.0% by mass to 20.0% by mass with respect to the whole of the ink.

In the ink jet recording apparatus, the ink may further contain resin except the organic compound.

In the ink jet recording apparatus, the amount of the organic compound contained in the ink may be larger than the amount of the resin contained in the ink.

In the ink jet recording apparatus, the amount of the organic compound contained in the ink may be larger than the sum of the amounts of the colorant and resin contained in the ink.

The ink jet recording apparatus may further include a pressurized cleaning mechanism cleaning the nozzle.

DESCRIPTION OF EXEMPLARY EMBODIMENTS

Figure 1:
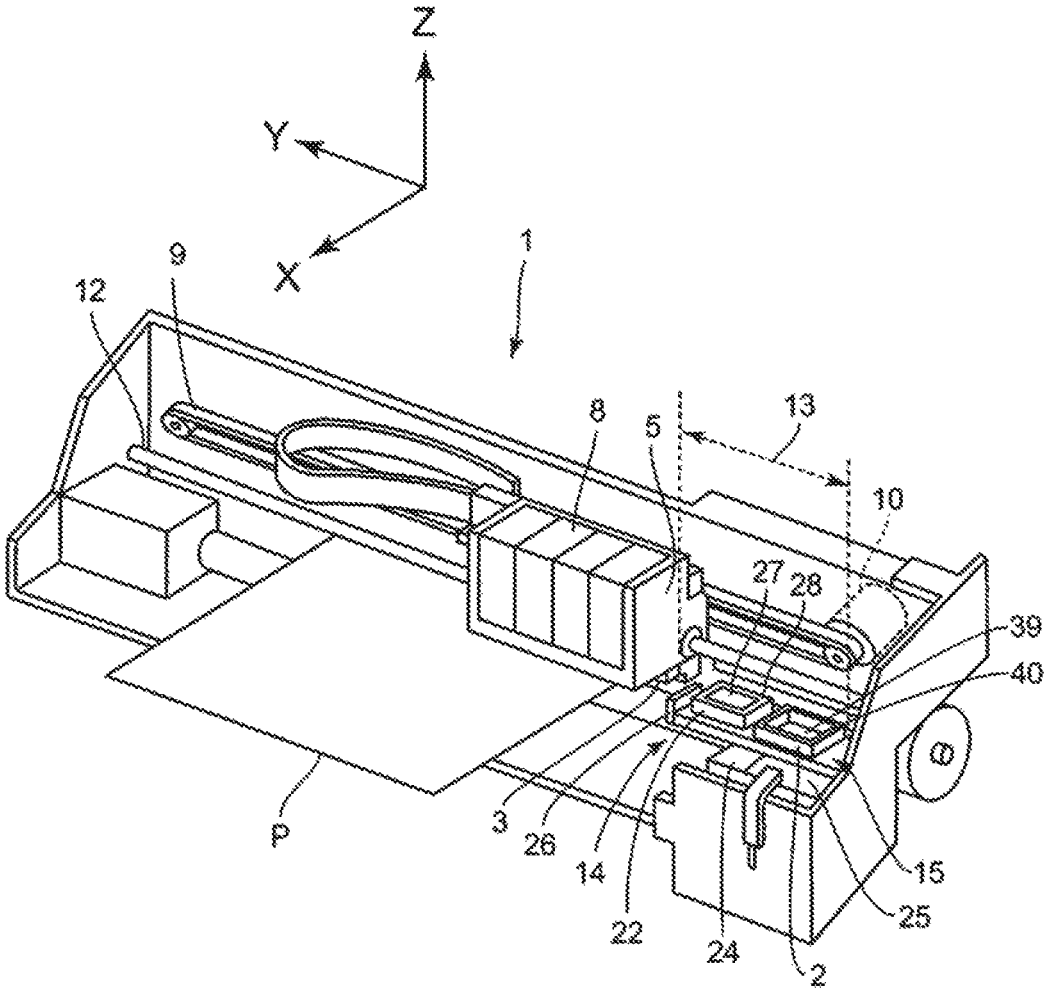
FIG. 1 is a schematic perspective view of an ink jet recording apparatus according to an embodiment of the present disclosure.

Some embodiments of the present disclosure are described below. The embodiments below are those describing examples of the present disclosure. The present disclosure is not at all limited to the embodiments below and includes various modifications made without departing from the spirit of the present disclosure. All configurations described below are not necessarily essential configurations of the present disclosure.

1. Ink Jet Recording Apparatus

An ink jet recording apparatus 1 according to an embodiment of the present disclosure includes a discharge head 3 including nozzles 16 discharging ink to a recording medium and a cap 2 which can cover the nozzles 16 of the discharge head 3 and which includes no ink absorber. The ink contains water, a colorant, and an organic compound which is solid at 25.0° C. and which has an octanol/water distribution coefficient of 0.0 or less.

1.1. Outline of Ink Jet Recording Apparatus

The ink jet recording apparatus 1 (hereinafter simply referred to as the printer 1 in some cases) is described below with reference to the attached drawings.

Figure 2:
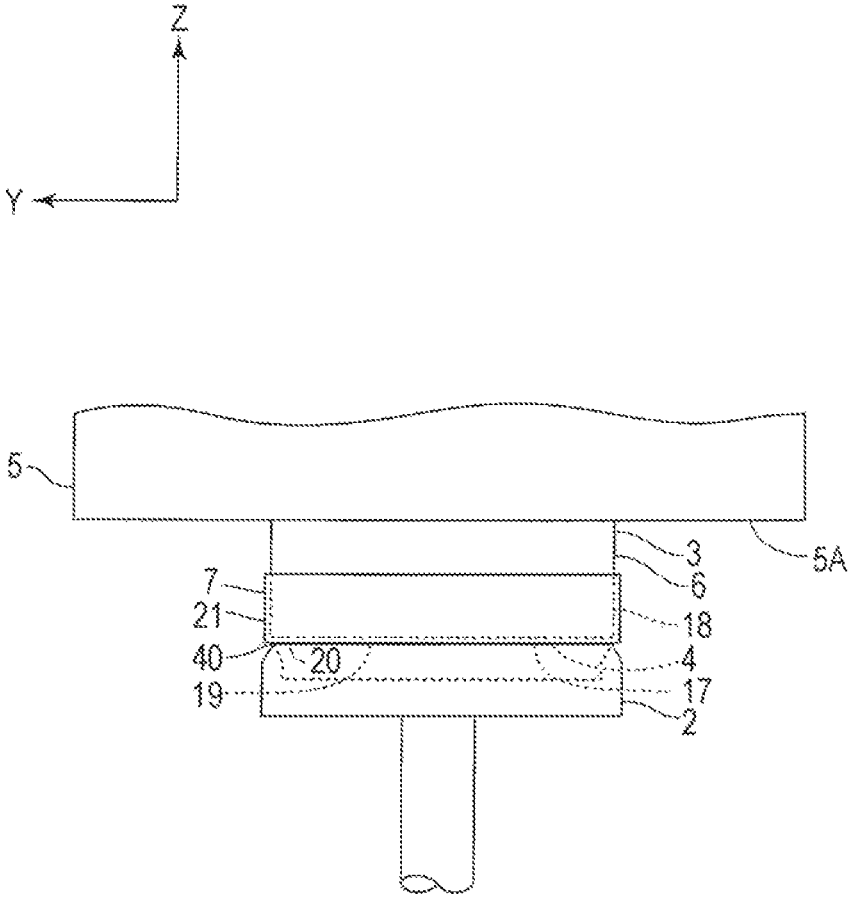
FIG. 2 is a schematic view illustrating a state in which a nozzle-formed surface of a discharge head is sealed with a cap as viewed from front.
Figure 3:
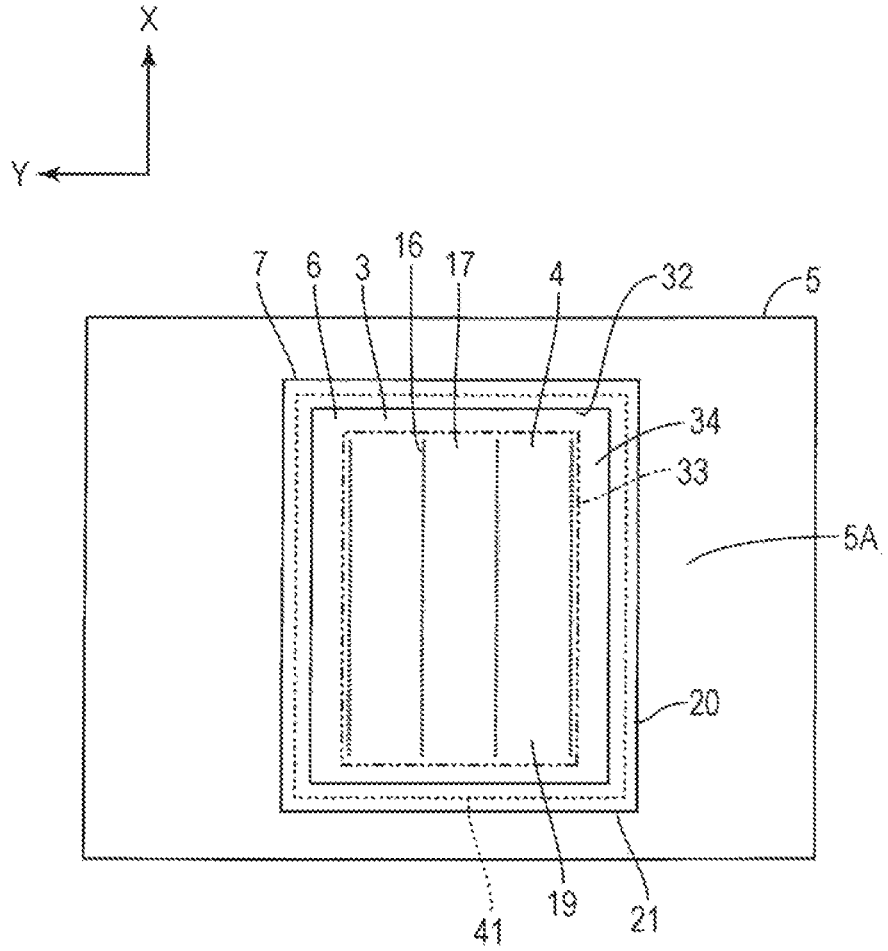
FIG. 3 is a schematic view of a discharge head attached to a carriage as viewed from below.
Figure 4A:
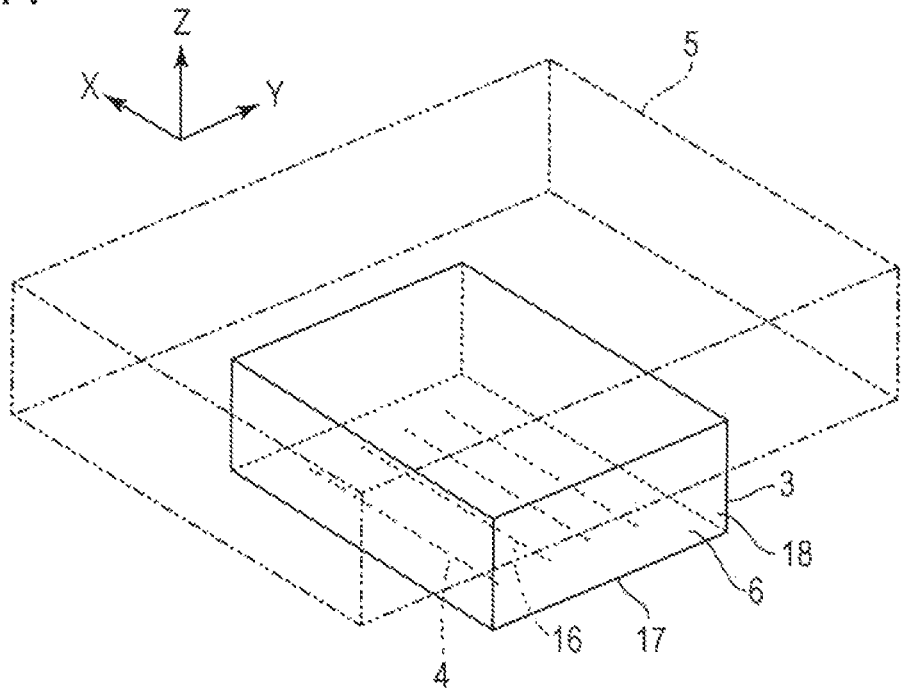
FIG. 4A is a schematic perspective view illustrating the appearance of a discharge head.
Figure 4B:
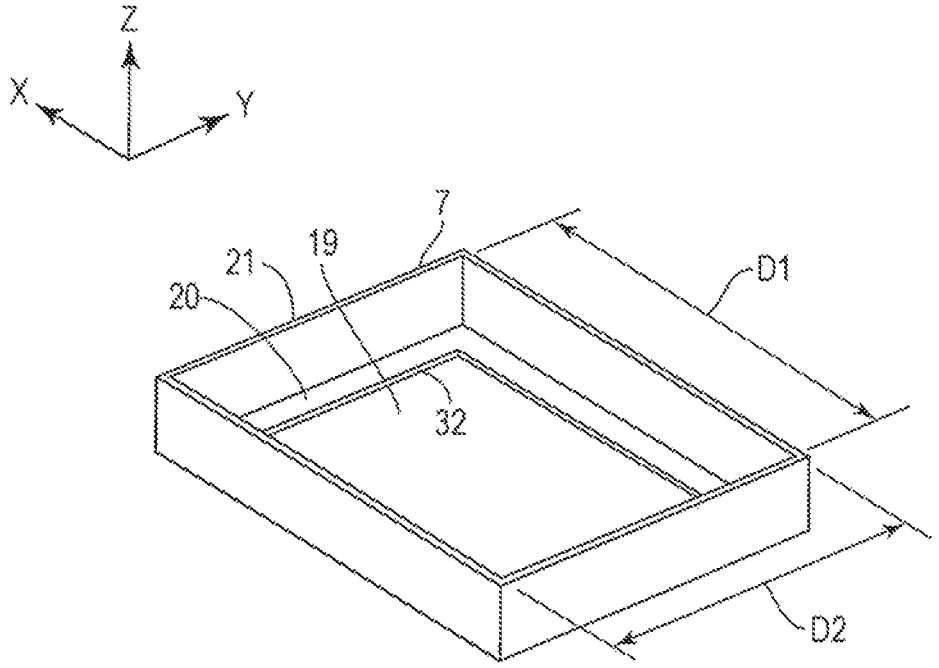
FIG. 4B is a schematic perspective view of a cover member.
Figure 5:
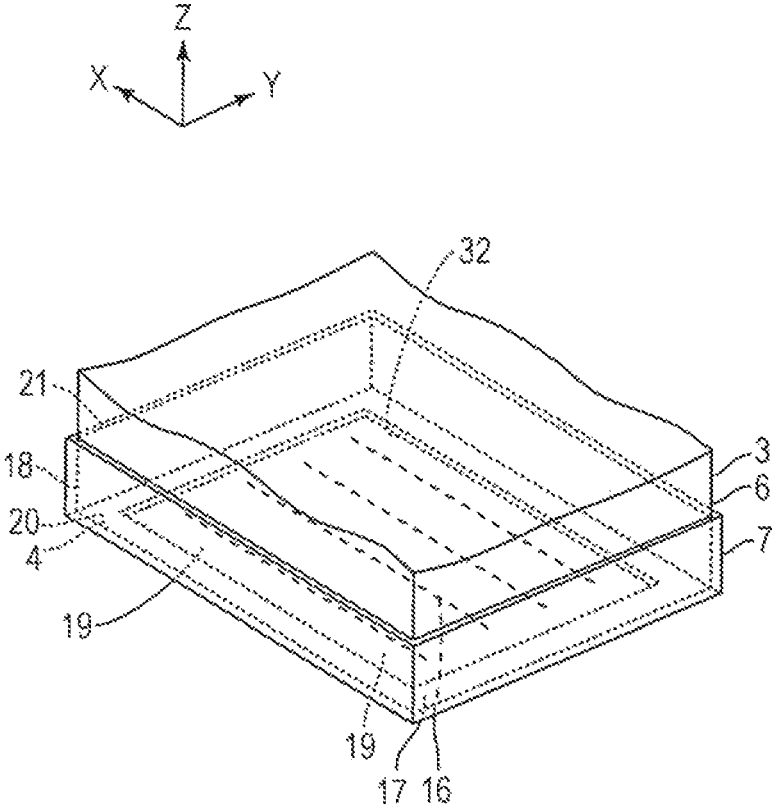
FIG. 5 is a schematic view illustrating a state in which a cover member is fitted to a discharge head.

FIG. 1 is a schematic perspective view of the ink jet recording apparatus 1. In descriptions below, a direction indicated by Arrow X shown in FIG. 1 is front, a direction indicated by Arrow Y is left, and a direction indicated by Arrow Z is above. FIG. 2 is a schematic view illustrating a state in which a nozzle-formed surface 4 of the discharge head 3 is sealed with the cap 2 as viewed from front. FIG. 3 is a schematic view of the discharge head 3 attached to a carriage 5 as viewed from below. FIG. 4A is a schematic perspective view illustrating the appearance of the discharge head 3. FIG. 4B is a schematic perspective view of a cover member 7. FIG. 5 is a schematic perspective view illustrating a state in which the cover member 7 is fitted to the discharge head 3.

1.1.1. Overall Configuration of Ink Jet Recording Apparatus

The ink jet recording apparatus 1 includes the carriage 5 such that an ink cartridge 8 is mounted on an upper portion of the carriage 5 and the discharge head 3, which serves as a liquid ejection head, is attached to the lower surface of the carriage 5. The carriage 5 is connected to a carriage motor 10 with a timing belt 9 therebetween and is guided with a guide bar 12 so as to be reciprocated in a main scanning direction (lateral direction) of a recording medium P that is a medium (recorded medium) to be recorded. The recording medium P used may be various types of paper, a film, a board, fabric, or the like.

The ink is stored in the ink cartridge 8 and is supplied to the discharge head 3 from the ink cartridge 8. Droplets of the ink are discharged to the upper surface of the recording medium P from the discharge head 3 while the discharge head 3 is being moved in the main scanning direction by the movement of the carriage 5 and the recording medium P is being moved front in a sub-scanning direction (a direction perpendicularly crossing the main scanning direction), whereby the ink is applied to the recording medium P. In other words, the discharge head 3 is reciprocated in the main scanning direction and a recording medium (the recording medium P) is conveyed in the sub-scanning direction, which crosses the main scanning direction, whereby an image is formed on the recording medium P.

As shown in FIG. 1, a non-recording region 13 is placed on the right side of a range in which the recording medium P is conveyed. The non-recording region 13 is provided with a cleaning mechanism 14 cleaning the discharge head 3 and a nozzle-protecting mechanism 15 capable of covering and protecting the nozzle-formed surface 4 of the discharge head 3.

As shown in FIGS. 3 to 5, the discharge head 3 includes a head body 6 which is supplied with the ink from the ink cartridge 8 to eject droplets of the ink, a nozzle plate 17 provided with the nozzles 16, and the like. The nozzle plate 17 is fitted to the lower surface of the head body 6. The discharge head 3 is attached to a mounting surface 5A that is the lower surface of the carriage 5 such that the nozzle-formed surface 4 of the nozzle plate 17 faces the recording medium P.

The cover member 7 is attached to the discharge head 3 so as to cover the discharge head 3 from a peripheral section of the nozzle-formed surface 4 to a side surface 18 of the head body 6. The cover member 7 includes a bottom plate section 20 provided with a rectangular opening section and a side plate section 21 erected around the bottom plate section 20 and is frame-shaped as a whole. The cover member 7 is fitted to the head body 6 such that the bottom plate section 20 faces the nozzle-formed surface 4 and the side plate section 21 extends along the side surface 18 of the head body 6 (see FIG. 5).

The shape and size of the opening section 19 is preset such that the nozzles 16 (see FIGS. 3 and 4A) can be located inside the opening section 19 in such a state that the cover member 7 is fitted to the discharge head 3 as described above. Thus, the ink can be discharged to the recording medium P from the nozzles 16 through the opening section 19. Fitting the cover member 7 to the discharge head 3 allows the bottom plate section 20 to be located between the nozzle-formed surface 4 and the recording medium P during recording. This suppresses the contact of the nozzle-formed surface 4 with the recording medium P during recording, thereby enabling the contamination of the recording medium P, the destruction of a meniscus, and the like to be suppressed.

The recording medium P is conveyed between the nozzle-formed surface 4 of the discharge head 3 and a platen, which is not shown. The platen has the function of appropriately maintaining the distance between the recording medium P and the nozzle-formed surface 4 and is shaped such that the nozzle-formed surface 4 is parallel to the recording medium P. Thus, when the discharge head 3 is present in a recording region in the absence of the recording medium P, the nozzle-formed surface 4 faces a surface of the platen. The distance between the platen surface and the nozzle-formed surface 4 is appropriately set depending on the type or thickness of the recording medium P used. When the recording medium P is, for example, fabric, the distance between the platen surface and the nozzle-formed surface 4 is 1.1 mm or more, preferably 1.3 mm or more, more preferably 1.5 mm or more, further more preferably 2.0 mm or more, and particularly preferably 2.2 mm or more. When the recording medium P is fabric, dust, fluff, or the like is likely to adhere to the nozzle-formed surface 4; hence, an effect of the present disclosure becomes more apparent.

The area that the recording medium P is conveyed per unit time in the sub-scanning direction during recording is not particularly limited. However, when the ink jet recording apparatus 1 is, for example, such a large-size recording apparatus that the conveyance area of the recording medium P is 5.0 $m^2$/h or more, preferably 10.0 $m^2$/h or more, more preferably 15.0 $m^2$/h or more, and further more preferably 15.0 $m^2$/h or more, the distance that the discharge head 3 travels is large. Therefore, the adhesion of dust, fluff, or the like to the nozzle-formed surface 4; the increase in frequency of cleaning; the extension of the period of a derelict state; and the like are likely to occur; hence, an effect of the present disclosure becomes more apparent.

1.1.2. Configuration and Operation of Cleaning Mechanism

Figure 6:
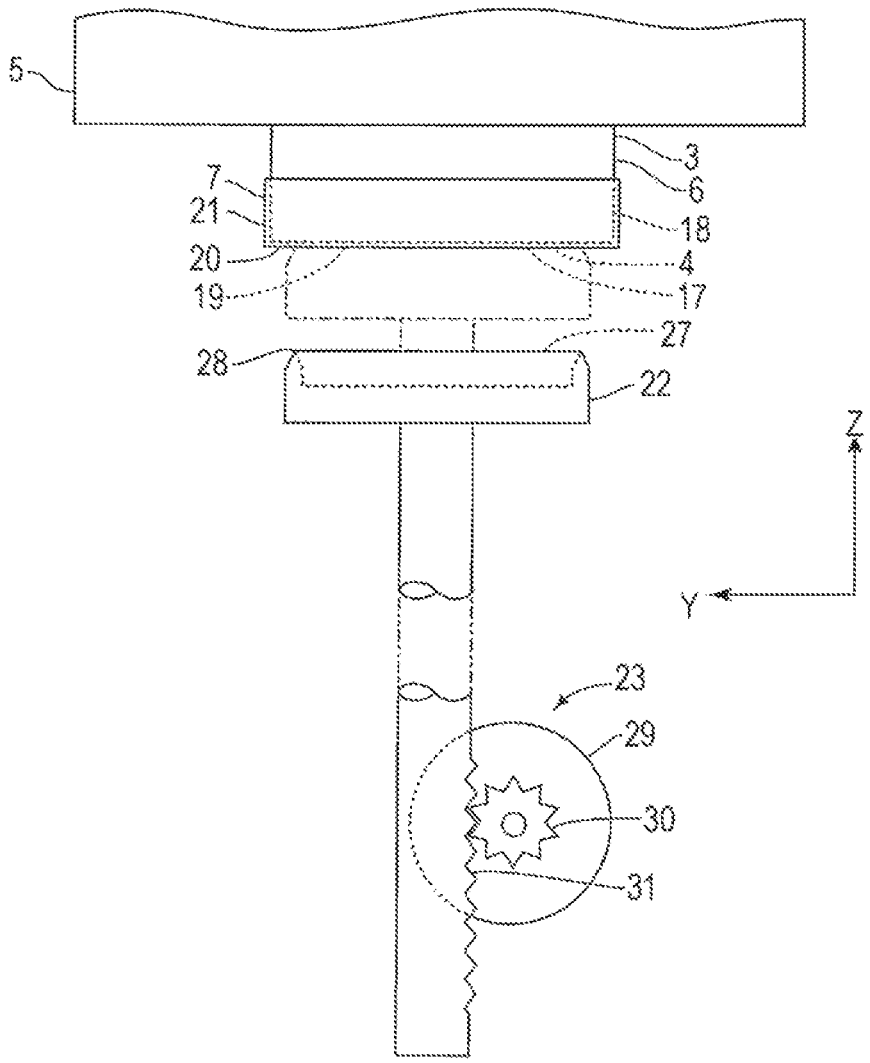
FIG. 6 is a schematic view of a sealing cap-elevating mechanism.

FIG. 6 is a schematic view of a sealing cap-elevating mechanism 23. As shown in FIG. 1, the cleaning mechanism 14 includes a sealing cap 22 capable of shielding the nozzles 16 of the discharge head 3 (see FIG. 3) from air, the sealing cap-elevating mechanism 23 (see FIG. 6), a suction pump 24 serving as a pump unit, a waste tank 25, a wiper 26 serving as a wiping means, and the like. The sealing cap 22 has an opening section 27 located above and is a bottomed box. The inside of the sealing cap 22 communicates with the suction pump 24 such that a negative pressure can be generated in the sealing cap 22 with the suction pump 24. The cleaning mechanism 14 can subject the discharge head 3 to cleaning treatments such as so-called flushing (idle ejection) in which the nozzles 16 are unclogged by discharging the ink from the nozzles 16 of the discharge head 3, a suction operation in which the ink present in the nozzles 16 is sucked, wiping in which the ink sticking to the nozzle-formed surface 4 is swept, and pressurized cleaning in which the nozzles 16 are unclogged in such a manner that the ink is ejected from the nozzles 16 of the discharge head 3 by applying a pressure to the ink present in channels in the discharge head 3.

The ink jet recording apparatus 1 moves the discharge head 3 to the non-recording region 13 every predetermined hours during recording and performs flushing with the cleaning mechanism 14. In the performance of flushing, first, the discharge head 3 is moved to the non-recording region 13 so as to be located directly above the sealing cap 22. The sealing cap 22 is raised with the sealing cap-elevating mechanism 23 (see FIG. 6) such that a peripheral portion of the opening section 27 of the sealing cap 22, that is, an upper end edge 28 of the sealing cap 22 abuts the nozzle-formed surface 4. The sealing cap-elevating mechanism 23 is configured such that the sealing cap 22 can be moved up and down by driving a driving motor 29. The driving force of the driving motor 29 is transferred to the sealing cap 22 side with a pinion gear 30 and rack gear 31 therebetween. Incidentally, the sealing cap-elevating mechanism 23 is placed below the sealing cap 22 and is not shown in FIG. 1.

As shown in FIG. 3, an abutting region 34 that the upper end edge 28 of the sealing cap 22 can abut is placed between an inner peripheral section 32 surrounding the opening section 19 of the bottom plate section 20 and a nozzle formation region 33 provided with the nozzles 16. The sealing cap 22 is raised with the sealing cap-elevating mechanism 23 such that the upper end edge 28 abuts the abutting region 34. In a state in which the upper end edge 28 abuts the abutting region 34, the nozzles 16 are sealed in the sealing cap 22 and are shielded from air outside the sealing cap 22.

A driving signal unrelated to recording is applied to the discharge head 3 in such a state that the nozzles 16 are sealed in the sealing cap 22, whereby flushing in which droplets of the ink are idly ejected is performed. The flushing allows the ink in the nozzles 16 to be discharged outside the nozzles 16. The discharged waste ink is discharged to the waste tank 25 with the suction pump 24. Incidentally, the sealing cap 22 may be configured to include an ink absorber. When the sealing cap 22 includes the ink absorber, the flushed ink is trapped with the ink absorber, thereby enabling the scattering of the ink in the sealing cap 22 to be suppressed and the adhesion of the waste ink to the nozzle-formed surface 4 to be suppressed. Since the waste ink is trapped with the ink absorber, the spilling or scattering of the waste ink from the sealing cap can be suppressed when the sealing cap 22 is separated from the nozzle-formed surface 4.

The suction operation is performed by the cleaning mechanism 14 as described below. In the suction operation, as well as flushing, the sealing cap 22 allows the upper end edge 28 thereof to abut the nozzle-formed surface 4 (abutting region 34) and the nozzles 16 are sealed inside the sealing cap 22. A negative pressure is generated in the sealing cap 22 with the suction pump 24, whereby the ink present in the nozzles 16 is sacked and discharged into the sealing cap 22. The suction operation, as well as flushing, enables the ink in the nozzles 16 to be discharged outside the nozzles 16, thereby enabling discharge failure caused by, for example, the drying or thickening of the ink to be improved. Furthermore, for pressurized cleaning, the ink in the nozzles 16 is discharged in such a manner that a pressure is applied to the ink present in ink channels with a pressure pump, which is not shown. The pressurized cleaning, as well as flushing, enables the ink in the nozzles 16 to be discharged outside the nozzles 16, thereby enabling discharge failure caused by, for example, the drying or thickening of the ink to be improved.

The upper end edge 28 of the sealing cap 22 is made of urethane rubber, silicone rubber, or the like and is configured such that the upper end edge 28 can adhere tightly to the nozzle plate 17 over the entire circumference thereof when the upper end edge 28 abuts the abutting region 34. Thus, when the upper end edge 28 abuts the nozzle plate 17 and a negative pressure is generated in the sealing cap 22, air can be inhibited from incoming from a contact portion between the upper end edge 28 and the nozzle plate 17. This enables the negative pressure necessary to suck the ink in the nozzles 16 to be reliably generated.

Wiping is performed as described below. First, the wiper 26 is allowed to be located in the movement route of the discharge head 3 with a wiper-elevating mechanism, which is not shown. The discharge head 3 is moved in the main scanning direction, whereby the nozzle-formed surface 4 is brought into slidable contact with the wiper 26. This allows the wiper 26 to sweep the ink sticking to the nozzle-formed surface 4.

1.1.3 Configuration and Operation of Nozzle-protecting Mechanism

The nozzle-protecting mechanism 15 includes the cap 2, a cap-elevating mechanism, and the like. The cap-elevating mechanism has substantially the same configuration as that of the above-mentioned sealing cap-elevating mechanism 23 (FIG. 6) and therefore is not shown. The nozzle-protecting mechanism 15 has the function of covering the nozzle-formed surface 4 with the cap 2 when the ink jet recording apparatus 1 is in a derelict state. The nozzle-formed surface 4 is covered with the cap 2 while the ink jet recording apparatus 1 is in a derelict state, whereby the evaporation of water in the ink present in the nozzles 16 is suppressed and the drying or thickening of the ink is suppressed. Furthermore, the adhesion of contaminants such as dust to nozzle-formed surface 4 can be suppressed. Incidentally, although the cap 2 can cover the nozzle-formed surface 4, the cap 2 has no mechanism generating a negative pressure unlike the sealing cap 22.

The term "derelict state" as used herein refers to a state in which no recording operation is performed until a next recording operation is performed after a recording operation based on a recording command issued from a computer or the like to the ink jet recording apparatus 1 is completed. In particular, for example, a state in which the ink jet recording apparatus 1 is de-energized because the ink jet recording apparatus 1 is switched off after a recording operation is completed is the derelict state. Furthermore, a state in which, even when a power supply is on, no recording operation is performed until a new recording command is issued to the ink jet recording apparatus 1 after a recording operation is completed is the derelict state. In the derelict state, if the nozzles 16 are exposed to outside air for a long time, then water in the ink evaporates and the ink thickens, whereby the nozzles may possibly be clogged. In order to suppress the occurrence of such a problem, the ink jet recording apparatus 1 includes the nozzle-protecting mechanism 15 and is configured such that the nozzle-formed surface 4 is covered with the cap 2, the evaporation of water in the ink present in the nozzles 16 can be suppressed, the drying or thickening of the ink can be suppressed, and the adhesion of contaminants to the nozzle-formed surface 4 can be suppressed in the derelict state.

Before falling into the derelict state, the ink jet recording apparatus 1 moves the discharge head 3 to the non-recording region 13 such that the discharge head 3 is located directly above the cap 2. The cap 2 is raised with the cap-elevating mechanism, whereby the cap 2 is allowed to abut the bottom plate section 20 of the cover member 7. The cap-elevating mechanism, as well as the sealing cap-elevating mechanism 23 (FIG. 6), is configured such that the cap 2 can be moved up and down by driving a driving motor. The driving force of the driving motor is transferred to the cap 2 side with a pinion gear and rack gear therebetween.

The cap 2 has an opening section 39 located above and is a bottomed box. As shown in FIG. 2, raising the cap allows a peripheral portion of the opening section 39, that is, an upper end edge 40 of the cap 2 to abut the bottom plate section 20. Thus, in a state in which the cap is raised and the upper end edge 40 abuts an abutting section 41 of the bottom plate section 20, the nozzle-formed surface 4 is covered with the cap 2 in such a state that the nozzle-formed surface 4 is shielded from air outside the cap 2. Allowing the cap 2 to abut the bottom plate section 20 and covering the nozzle-formed surface 4 such that the nozzle-formed surface 4 is shielded from air as described above enables the evaporation of water in the ink present in the nozzles 16 to be suppressed and, for example, the drying or thickening of the ink to be suppressed. Furthermore, the adhesion of contaminants to the nozzle-formed surface 4 can be suppressed.

The upper end edge 40 of the cap 2 is made of urethane rubber, silicone rubber, or the like and is configured such that the upper end edge 40 can adhere tightly to the bottom plate section 20 over the entire circumference thereof when the upper end edge 40 abuts the bottom plate section 20. The cap 2 is configured to have no gap leading to the outside of the cap 2 except the opening section 27. Thus, the passage of air between the upper end edge 40 and the abutting section 41 of the bottom plate section 20 is suppressed; hence, the change in humidity in the cap 2 is small.

No ink absorber is preferably placed inside the cap 2. However, an ink absorber may be placed inside the cap 2. The ink absorber is, for example, a porous material or may be an inorganic material such as silica or alumina, sponge of a urethane resin or a polyester resin, a nonwoven fabric.

1.1.4. Function of Cap

As described above, the cap 2 can suppresses the evaporation of water in the ink in nozzles 16 to suppress, for example, the drying or thickening of the ink. However, when the ink absorber is placed in the cap 2, water is absorbed by the ink absorber in some cases, whereby water is stripped from the ink in the nozzles 16 and nozzle clogging occurs in some cases. Therefore, it is conceivable that no ink absorber is preferably placed in the cap 2.

When no ink absorber is placed in the cap 2, there are advantages that manufacturing costs can be reduced because of no ink absorber and each row of the nozzles 16 can be capped. However, even in the case of using a cap equipped with no ink absorber therein, nozzle clogging during capping has not been capable of being suppressed in some cases.

As a result of investigations, it has become clear that such a phenomenon is caused by the fact that the meniscus of ink in a nozzle is broken by dust or fluff adhering to a nozzle-formed surface and the ink sticks to the inside of the cap from the nozzle during capping. That is, when the ink drips into the cap, the ink dries and moisture absorption by the dry ink occurs in some cases. It is conceivable that, in the case of performing capping using the cap in such a state that the dry ink is present in the cap, the movement of water from the ink in the nozzle to the dry ink is a cause of discharge failure.

In the ink jet recording apparatus 1, the ink, in which water is unlikely to move, is used. Therefore, even if the ink drips into the cap 2 and dries, the ink in the nozzles 16 is unlikely to dry in the case of performing capping. Using the ink is unlikely to cause discharge failure even when no ink absorber is present in the cap 2 or even when the ink absorber is placed in the cap 2. That is, the ink jet recording apparatus 1 is achieved on the basis of a concept that the movement of water that is one of fundamental causes of discharge failure is suppressed using ink with a specific composition.

1.2. Ink

The ink jet recording apparatus 1 discharges the ink from the nozzles 16 of the above-mentioned discharge head 3 as described below. The ink contains water, the colorant, and the organic compound, which is solid at 25.0° C. and has an octanol/water distribution coefficient of 0.0 or less.

1.2.1. Water

The ink, which is used in the ink jet recording apparatus 1, contains water. The ink is an aqueous ink. The term "aqueous" means that water is contained as one of major solvent components. Water may be contained as a main solvent component of the ink and is a component which is evaporated or scattered by drying. Water is preferably pure water such as ion-exchanged water, ultrafiltered water, reverse osmosis-purified water, or distilled water or one, such as ultrapure water, substantially free from ionic impurities. Water sterilized by ultraviolet irradiation or the addition of hydrogen peroxide is preferably used because the growth of mold and bacteria can be suppressed in the case of storing the ink for a long period. The content of water in the ink is preferably 45% by mass or more, more preferably 50% by mass to 98% by mass, and further more preferably 55% by mass to 95% by mass.

1.2.2. Colorant

The ink contains the colorant. The colorant used may be either of pigment and dye or may be an inorganic pigment including carbon black, an organic pigment, an oil-soluble dye, an acidic dye, a direct dye, a reactive dye, a basic dye, a disperse dye, a sublimation dye, or the like. In the ink, the colorant may be dispersed with a dispersion resin.

The inorganic pigment used may be carbon black (C.I. Pigment Black 7) such as furnace black, lamp black, acetylene black, or channel black; iron oxide; titanium oxide; zinc oxide; silica; or the like.

Examples of the carbon black include those, such as No. 2300, 900, MCF88, No. 20B, No. 33, No. 40, No. 45, No. 52, MA7, MA8, MA100, and No. 2200B, produced by Mitsubishi Chemical Corporation; those, such as Color Black FW1, FW2, FW2V, FW18, FW200, 5150, 5160, 5170, Printex 35, U, V, 140U, Special Black 6, 5, 4A, 4, and 250, produced by Degussa AG; those, such as Conductex SC, Raven 1255, 5750, 5250, 5000, 3500, 1255, and 700, produced by Columbian Carbon, Ltd.; and those, such as Regal 400R, 330R, 660R, Mogul L, Monarch 700, 800, 880, 900, 1000, 1100, 1300, 1400, and Elftex 12, produced by Cabot Corporation.

The following pigment can be exemplified as the organic pigment: a quinacridone pigment, a quinacridonequinone pigment, a dioxazine pigment, a phthalocyanine pigment, an anthrapyrimidine pigment, an anthanthrone pigment, an indanthrone pigment, a flavanthrone pigment, a perylene pigment, a diketopyrrolopyrrole pigment, a perinone pigment, a quinophthalone pigment, an anthraquinone pigment, a thioindigo pigment, a benzimidazolone pigment, an isoindolinone pigment, an azomethine pigment, or an azo pigment.

Examples of the organic pigment, which is used in the ink, are cited below.

As a cyan pigment, C.I. Pigment Blue 1, 2, 3, 15:3, 15:4, 15:34, 16, 22, or 60; C.I. Vat Blue 4 or 60; or the like is cited and a mixture containing one or more selected from the group consisting of C.I. Pigment Blues 15:3, 15:4, and 60 can be preferably exemplified.

As a magenta pigment, C.I. Pigment Red 5, 7, 12, 48(Ca), 48(Mn), 57(Ca), 57:1, 112, 122, 123, 168, 184, or 202; C.I. Pigment Violet 19; or the like is cited and a mixture containing one or more selected from the group consisting of C.I. Pigment Reds 122, 202, and 209 and C.I. Pigment Violet 19 can be preferably exemplified.

As a yellow pigment, C.I. Pigment Yellow 1, 2, 3, 12, 13, 14C, 16, 17, 73, 74, 75, 83, 93, 95, 97, 98, 119, 110, 114, 128, 129, 138, 150, 151, 154, 155, 180, or 185 or the like is cited and a mixture containing one or more selected from the group consisting of C.I. Pigment Yellows 74, 109, 110, 128, and 138 can be preferably exemplified.

As an orange pigment, C.I. Pigment Orange 36 or 43 or a mixture thereof can be exemplified. As pigment used in a green ink, C.I. Pigment Green 7 or 36 or a mixture thereof can be exemplified.

The above-exemplified pigments are preferable examples of the pigment. The present disclosure is not limited by these pigments. These pigments may be used alone or in combination or may be used in combination with dye.

The pigment may be used in the form of a pigment dispersion obtained using a dispersant selected from a water-soluble resin, a water-dispersible resin, and a surfactant or may be used in the form of a self-dispersible pigment obtained by oxidizing or sulfonating the surface of the pigment using ozone, hypochlorous acid, fuming sulfuric acid, or the like.

In the ink, in the case of dispersing the pigment with a dispersion resin, the ratio of the pigment to the dispersion resin is preferably 10:1 to 1:10 and more preferably 4:1 to 1:3. The volume-average particle size of the dispersed pigment is preferably 300 nm or less as measured by a dynamic light scattering method and more preferably 200 nm or less and the maximum particle size thereof is less than 500 nm.

As dye usable in the ink, water-soluble dyes such as an acidic dye, a direct dye, a reactive dye, and a basic dye and water-dispersible dyes such as a disperse dye, an oil-soluble dye, and a sublimation dye can be cited.

As the acidic dye, C.I. Acid Yellows 17, 23, 42, 44, 79, and 142; C.I. Acid Reds 52, 80, 82, 249, 254, and 289; C.I. Acid Blues 9, 45, and 249; C.I. Acid Blacks 1, 2, 24, and 94; and the like can be cited.

As the direct dye, C.I. Direct Yellows 1, 12, 24, 33, 50, 55, 58, 86, 132, 142, 144, and 173; C.I. Direct Reds 1, 4, 9, 80, 81, 225, and 227; C.I. Direct Blues 1, 2, 15, 71, 86, 87, 98, 165, 199, and 202; C.I. Direct Blacks 19, 38, 51, 71, 154, 168, and 195; C.I. Direct Blues 2, 3, 8, 10, 12, 31, 35, 63, 116, 130, 149, 199, 230, and 231; and the like can be cited.

As the reactive dye, C.I. Reactive Yellows 2, 7, 15, 22, 37, 42, 57, 69, 76, 81, 95, 102, 125, and 135; C.I. Reactive Reds 2, 14, 24, 32, 55, 79, 106, 111, and 124; C.I. Reactive Blues 2, 13, 21, 38, 41, 50, 69, 72, 109, 120, and 143; C.I. Reactive Blacks 3, 4, 5, 8, 13, 14, 31, 34, 35, and 39; and the like can be cited.

As the basic dye, C.I. Basic Yellows 1, 2, 13, 19, 21, 25, 32, 36, 40, and 51; C.I. Basic Reds 1, 5, 12, 19, 22, 29, 37, 39, and 92; C.I. Basic Blues 1, 3, 9, 11, 16, 17, 24, 28, 41, 45, 54, 65, and 66; C.I. Basic Blacks 2 and 8; and the like can be cited.

The disperse dye and oil-soluble dye used may be colorants that are not dissolved but are dispersed in an ink vehicle. As the disperse dye and the oil-soluble dye, an azo dye, a metal-complex azo dye, an anthraquinone dye, a phthalocyanine dye, a triarylmethane dye, and the like can be cited.

As the disperse dye, C.I. Disperse Reds 60, 82, 86, 86:1, 167:1, and 279; C.I. Disperse Yellows 64, 71, 86, 114, 153, 233, and 245; C.I. Disperse Blues 27, 60, 73, 77, 77:1, 87, 257, and 367; C.I. Disperse Violets 26, 33, 36, and 57; C.I. Disperse Oranges 30, 41, and 61; and the like can be cited.

As the oil-soluble dye, C.I. Solvent Yellows 16, 21, 25, 29, 33, 51, 56, 82, 88, 89, 150, and 163; C.I. Solvent Reds 7, 8, 18, 24, 27, 49, 109, 122, 125, 127, 130, 132, 135, 218, 225, and 230; C.I. Solvent Blues 14, 25, 35, 38, 48, 67, 68, 70, and 132; C.I. Solvent Blacks 3, 5, 7, 27, 28, 29, and 34; and the like can be cited.

The sublimation dye used may be a disperse dye, oil-soluble, or the like having the above properties. Examples of such a dye include C.I. Disperse Yellows 3, 7, 8, 23, 39, 51, 54, 60, 71, and 86; C.I. Disperse Oranges 1, 1:1, 5, 20, 25, 25:1, 33, 56, and 76; C.I. Disperse Brown 2; C.I. Disperse Reds 11, 50, 53, 55, 55:1, 59, 60, 65, 70, 75, 93, 146, 158, 190, 190:1, 207, 239, and 240; C.I. Vat Red 41; C.I. Disperse Violets 8, 17, 23, 27, 28, 29, 36, and 57; C.I. Disperse Blues 19, 26, 26:1, 35, 55, 56, 58, 64, 64:1, 72, 72:1, 81, 81:1, 91, 95, 108, 131, 141, 145, and 359; and C.I. Solvent Blues 36, 63, 105, and 111. These may be used alone or in combination.

The above-exemplified dyes are preferable examples of the colorant. The present disclosure is not limited by these dyes. These dyes may be used alone or in combination or may be used in combination with pigment.

The content of the colorant in the ink may be appropriately adjusted depending on applications and is preferably 0.10% by mass to 20.0% by mass, more preferably 0.20% by mass to 15.0% by mass, and further more preferably 1.0% by mass to 10.0% by mass.

1.2.3. Organic Compound

The ink contains the organic compound, which is solid at 25.0° C. and has an octanol/water distribution coefficient of 0.0 or less. The organic compound, which is solid at 25.0° C. and has an octanol/water distribution coefficient of 0.0 or less, is hereinafter referred to as the "specific organic compound" in some cases.

The fact that a compound is solid at 25.0° C. means that the compound exhibits solid properties at 25.0° C. and 1.0 atm. When organic compounds have a melting point of 25.0° C. or more, the organic compounds are likely to be in a solid phase (solid) at 25.0° C. and 1.0 atm. Organic compounds which have a melting point of less than 25.0° C. and which can exhibit solid properties at 25.0° C. because of supercooling are included in organic compounds which are solid at 25.0° C.

The octanol/water distribution coefficient is a value referred to as a log P value and refers to a value defined in OECD Test Guideline 107. As the log P value is larger, the hydrophobicity is higher. As the log P value is smaller, the hydrophilicity is higher.

The specific organic compound, which is contained in the ink, preferably has an octanol/water distribution coefficient of −0.3 or less, more preferably −0.5 or less, and further more preferably −1.0.

Examples of the specific organic compound include trimethylolpropane, thiourea, urea, and polyvinylpyrrolidone. Among these, polyvinylpyrrolidone, which varies in melting point or octanol/water distribution coefficient depending on the molecular weight, the K-value, or the like, preferably has, for example, a viscosity-average molecular weight of 20,000 to 60,000, more preferably 30,000 to 50,000, and further more preferably 35,000 to 45,000. The K-value of polyvinylpyrrolidone is preferably, for example, 5 to 50, more preferably 10 to 45, further more preferably 20 to 40, and still further more preferably 25 to 35.

The content of the specific organic compound in the ink is preferably 1.0% by mass to 30.0% by mass with respect to the whole of the ink, more preferably 2.0% by mass to 25.0% by mass, further more preferably 3.0% by mass to 20.0% by mass, and still further more preferably 5.0% by mass to 15.0% by mass. The specific organic compound has a preferable content relative to other components. This is described in the item "1.2.4.3. Relative Amounts of Specific Organic Compound, Resin, and Colorant".

1.2.4. Other Components 1.2.4.1. Dispersant

The ink may contain a dispersant for pigments or sublimation dyes. The dispersant has the function of dispersing the above-mentioned pigment and sublimation dye in the ink. The dispersant is not particularly limited and may be an anionic dispersant, a nonionic dispersant, or a polymer dispersant (resin dispersant).

The anionic dispersant is preferably an aromatic sulfonic acid-formaldehyde condensate. Examples of the "aromatic sulfonic acid" in the aromatic sulfonic acid-formaldehyde condensate include alkylnaphthalenesulfonic acids such as creosote oil sulfonic acid, cresolsulfonic acid, phenolsulfonic acid, β-naphtholsulfonic acid, methylnaphthalenesulfonic acid, and butylnaphthalenesulfonic acid; a mixture of β-naphthalenesulfonic acid and β-naphtholsulfonic acid; a mixture of cresolsulfonic acid and 2-naphthol-6-sulfonic acid; lignin sulfonic acid; and salts thereof.

The anionic dispersant is preferably a β-naphthalenesulfonic acid-formaldehyde condensate, an alkylnaphthalenesulfonic acid-formaldehyde condensate, a creosote oil sulfonic acid-formaldehyde condensate, or a salt thereof and is more preferably a sodium salt thereof.

The nonionic dispersant is an ethylene oxide adduct of phytosterol, an ethylene oxide adduct of cholestanol, or the like.

Among these, commercially available products of a naphthalenesulfonic acid dispersant include dispersants, such as DEMOL NL, DEMOL MS, DEMOL N, DEMOL RN, DEMOL RN-L, DEMOL SC-30, DEMOL SN-B, DEMOL SS-L, DEMOL T, and DEMOL T-45, produced by Kao Corporation.

Examples of the polymer dispersant (also referred to as the "resin dispersant") include (meth)acrylic resins such as poly(meth)acrylic acid, (meth)acrylic acid-acrylonitrile copolymers, (meth)acrylic acid-(meth)acrylate copolymers, vinyl acetate-(meth)acrylate copolymers, vinyl acetate-(meth)acrylic acid copolymers, and vinylnaphthalene-(meth)acrylic acid copolymers; salts of the (meth)acrylic resins; styrenic resins such as styrene-(meth)acrylic acid copolymers, styrene-(meth)acrylic acid-(meth)acrylate copolymers, styrene-α-methylstyrene-(meth)acrylic acid copolymers, styrene-α-methylstyrene-(meth)acrylic acid-(meth)acrylate copolymers, styrene-maleic acid copolymers, and styrene-maleic anhydride copolymers; salts of the styrenic resins; urethanic resins which are polymeric compounds (resins) containing a urethane bond formed by the reaction of a isocyanate group with a hydroxyl group, which may be linear and/or branched, and in which the presence or absence of a crosslinking structure does not matter; salts of the urethanic resins; polyvinyl alcohols; vinylnaphthalene-maleic acid copolymers; salts of the vinylnaphthalene-maleic acid copolymers; vinyl acetate-maleate copolymers; salts of the vinyl acetate-maleate copolymers; and water-soluble resins such as vinyl acetate-crotonic acid copolymers and salts thereof.

Commercially available products of a styrenic resin dispersant include, for example, X-200, X-1, X-205, X-220, X-228 (produced by Seiko PMC Corporation), Nopcosperse® 6100, 6110 (produced by San Nopco, Ltd.), Joncryl 67, 586, 611, 678, 680, 682, 819 (produced by BASF), DISPERBYK-190 (produced by BYK Chemie Japan K.K.), N-EA137, N-EA157, N-EA167, N-EA177, N-EA197D, N-EA207D, and E-EN10 (produced by Dai-ichi Kogyo Seiyaku Co., Ltd.).

Commercially available products of an acrylic resin dispersant include BYK-187, BYK-190, BYK-191, BYK-194N, BYK-199 (produced by BYK Chemie Japan K.K.), Aron A-210, A-6114, AS-1100, AS-1800, A-30SL, A-7250, and CL-2 (produced by TOAGOSEI Co., Ltd.).

Furthermore, commercially available products of a urethanic resin dispersant include BYK-182, BYK-183, BYK-184, BYK-185 (produced by BYK Chemie Japan K.K.), TEGO Disperse 710 (produced by Evonik Tego Chemie GmbH), and Borchi® Gen 1350 (produced by OMG Borchers Gmbh).

The dispersant may be used alone or in combination with one or more dispersants. The content of the dispersant in the ink is preferably 0.1% by mass to 30% by mass, more preferably 0.5% by mass to 25% by mass, further more preferably 1% by mass to 20% by mass, and still further more preferably 1.5% by mass to 15% by mass. When the content of the dispersant is 0.1% by mass or more, the dispersion stability of the sublimation dye can be ensured. When the content of the dispersant is 30% by mass or less, the sublimation dye is not excessively dissolved and the viscosity can be kept low.

Among the above-exemplified dispersants, the resin dispersant, particularly at least one selected from the group consisting of an acrylic resin, a styrenic resin, and a urethanic resin is more preferable. In this case, the weight-average molecular weight of the dispersant is more preferably 500 or more. When the dispersant used is such a resin dispersant, a smell is slight and the dispersion stability of the sublimation dye can be further enhanced.

1.2.4.2. Resin Particles

The ink may contain resin particles. The resin particles function as a so-called fixing resin increasing the adhesion of the ink applied to the recording medium. The resin particles are, for example, those made of a urethanic resin, an acrylic resin, a styrene-acrylic resin, a fluorine-based resin, a polyolefinic resin, a rosin-modified resin, a terpenic resin, a polyester resin, a polyamide resin, an epoxy resin, a vinyl chloride resin, a vinyl chloride-vinyl acetate copolymer, an ethylene-vinyl acetate copolymer, and the like. The resin particles are often handled in the form of emulsion and may be in the form of powder. The resin particles may be used alone or in combination with other resin particles.

The term "urethanic resin" is a generic name for resins containing a urethane bond. The urethanic resin used may be a polyether-type urethane resin having a main chain containing an ether bond in addition to a urethane bond, a polyester-type urethane resin having a main chain containing an ester bond, a polycarbonate-type urethane resin having a main chain containing a carbonate bond, or the like. The urethanic resin used may be a commercially available product or may be, for example, a non-cohesive one selected from commercially available products such as SUPERFLEX 460, 460s, 840, E-4000 (trade name, produced by Dai-ichi Kogyo Seiyaku Co., Ltd.), Resamine D-1060, D-2020, D-4080, D-4200, D-6300, D-6455 (trade name, produced by Dainichiseika Color & Chemicals Mfg. Co., Ltd.), Takelac WS-6021, W-512-A-6 (trade name, produced by Mitsui Chemical Polyurethane Inc.), Sancure 2710 (trade name, produced by Lubrizol Corporation), Permarin UA-150 (trade name, produced by Sanyo Chemical Industries, Ltd.), and the like.

The term "acrylic resin" is a generic name for polymers obtained by polymerizing at least one acrylic monomer such as (meth)acrylic acid or (meth)acrylate and includes, for example, resin obtained from an acrylic monomer, a copolymer of the acrylic monomer and a monomer other than the acrylic monomer, and the like. The acrylic resin is, for example, an acryl-vinyl resin that is a copolymer of the acrylic monomer and a vinylic monomer or a copolymer of the acrylic monomer and a vinylic monomer such as styrene.

The acrylic monomer used may be acrylamide, acrylonitrile, or the like. A resin emulsion produced from the acrylic resin may be a commercially available product or may be, for example, a non-cohesive one selected from FK-854 (trade name, produced by CHIRIKA Co., Ltd.), Mowinyl 952B, 718A (trade name, produced by The Nippon Synthetic Chemical Industry Co., Ltd.), Nipol LX852, LX874 (trade name, produced by ZEON Corporation), and the like.

In the present specification, the acrylic resin may be a styrene-acrylic resin. In the present specification, the term "(meth)acrylic" refers to at least one of acrylic and methacrylic.

The styrene-acrylic resin is a copolymer obtained from a styrene monomer and an acrylic monomer. Examples of the styrene-acrylic resin include a styrene-acrylic acid copolymer, a styrene-methacrylic acid copolymer, a styrene-methacrylic acid-acrylate copolymer, a styrene-α-methylstyrene-acrylic acid copolymer, and a styrene-α-methylstyrene-acrylic acid-acrylate copolymer. The styrene-acrylic resin used may be a commercially available product or may be, for example, a non-cohesive one selected from Joncryl 62J, 7100, 390, 711, 511, 7001, 632, 741, 450, 840, 74J, HRC-1645J, 734, 852, 7600, 775, 537J, 1535, PDX-7630A, 352J, 352D, PDX-7145, 538J, 7640, 7641, 631, 790, 780, 7610 (trade name, produced by BASF), Mowinyl 966A, 975N (trade name, produced by The Nippon Synthetic Chemical Industry Co., Ltd.), Vinyblan 2586 (trade name, produced by Nissin Chemical Industry Co., Ltd), and the like.

The polyolefinic resin is one having a structural skeleton derived from an olefin such as ethylene, propylene, or butylene and may be a known one appropriately selected. The polyolefinic resin used may be a commercially available product or may be, for example, a non-cohesive one selected from ARROWBASE CB-1200 and CD-1200 (trade name, produced by Unitika Ltd.).

The resin particles may be supplied in the form of emulsion. An example of a commercially available product of such a resin emulsion may be a non-cohesive one selected from Microgel E-1002, E-5002 (produced by Nippon Paint Co., Ltd., trade name, styrene-acrylic resin emulsion), Voncoat 4001 (produced by DIC Corporation, trade name, acrylic resin emulsion), Voncoat 5454 (produced by DIC Corporation, trade name, acrylic resin emulsion), Polysol AM-710, AM-920, AM-2300, AP-4735, AT-860, PSASE-4210E (acrylic resin emulsion), Polysol AP-7020 (styrene-acrylic resin emulsion), Polysol SH-502 (vinyl acetate resin emulsion), Polysol AD-13, AD-2, AD-10, AD-96, AD-17, AD-70 (ethylene-vinyl acetate resin emulsion), Polysol PSASE-6010 (ethylene-vinyl acetate resin emulsion) (produced by Showa Denko K.K., trade name), Polysol SAE 1014 (trade name, styrene-acrylic resin emulsion, produced by ZEON Corporation), Saibinol SK-200 (trade name, acrylic resin emulsion, produced by Saiden Chemical Industry Co., Ltd.), AE-120A (produced by JSR Corporation, trade name, acrylic resin emulsion), AE373D (produced by Emulsion Technology Co., Ltd., trade name, carboxy-modified styrene-acrylic resin emulsion), Seikadain 1900W (produced by Dainichiseika Color & Chemicals Mfg. Co., Ltd., trade name, ethylene-vinyl acetate resin emulsion), Vinyblan 2682 (acrylic resin emulsion), Vinyblan 2886 (vinyl acetate-acrylic resin emulsion), an, such as Vinyblan 5202 (acrylic acetate resin emulsion) (produced by Nissin Chemical Industry Co., Ltd, trade name), elitel KA-5071S, KT-8803, KT-9204, KT-8701, KT-8904, KT-0507 (produced by Unitika Ltd., trade name, polyester resin emulsion), Hytec SN-2002 (produced by Toho chemical Industry Co., Ltd., trade name, polyester resin emulsion), Takelac W-6020, W-635, W-6061, W-605, W-635, W-6021 (produced by Mitsui Chemical Polyurethane Inc., trade name, urethanic resin emulsion), SUPERFLEX 870, 800, 150, 420, 460, 470, 610, 700 (produced by Dai-ichi Kogyo Seiyaku Co., Ltd., trade name, urethanic resin emulsion), Permarin UA-150 (produced by Sanyo Chemical Industries, Ltd., urethanic resin emulsion), Sancure 2710 (produced by Japan Lubrizol Corporation, urethanic resin emulsion), NeoRez R-9660, R-9637, R-940 (produced by Kusumoto Chemicals, Ltd., urethanic resin emulsion), ADEKA BONTIGHTER HUX-380, 290K (produced by Adeka Corporation, urethanic resin emulsion), Mowinyl 966A, Mowinyl 7320 (produced by The Nippon Synthetic Chemical Industry Co., Ltd.), Joncryl 7100, 390, 711, 511, 7001, 632, 741, 450, 840, 74J, HRC-1645J, 734, 852, 7600, 775, 537J, 1535, PDX-7630A, 352J, 352D, PDX-7145, 538J, 7640, 7641, 631, 790, 780, 7610 (the above, produced by BASF), NK Binder R-5HN (produced by Shin-Nakamura Chemical Co., Ltd.), Hydran WLS-210 (non-crosslinked polyurethane: produced by DIC Corporation), and Joncryl 7610 (produced by BASF).

When the ink contains the resin particles, the content of the resin particles in the ink is preferably 0.1% by mass to 20% by mass in terms of solid matter, more preferably 1% by mass to 15% by mass, and further more preferably 2% by mass to 10% by mass. 1.2.4.3. Relative Amounts of Specific Organic Compound, Resin, and Colorant As described above, the ink contains the colorant and may contain one or more selected from the resin dispersant and the resin particles as arbitrary components. Herein, the amount of the specific organic compound contained in the ink is preferably larger than the sum of the amounts of the colorant and resin contained in the ink. Herein, the amount of the resin is the sum of the amounts of solids in the resin dispersant and the resin particles. According to such a relative amount, the drying of the ink is suppressed, whereby the movement of water in a cap is more likely to be suppressed.

The amount of the specific organic compound contained in the ink is preferably larger than the amount of the resin contained in the ink. Likewise, the amount of the resin is the sum of the amounts of solids in the resin dispersant and the resin particles. According to such a relative amount, the drying of the ink is suppressed, whereby the movement of water in the cap is more likely to be suppressed. This effect is particularly effective when the sublimation dye is contained in the ink. When the sublimation dye is contained in the ink, nozzle clogging occurs in some cases because the solvent composition of the ink in a nozzle varies due to the movement of water in the cap, the dispersion state of the sublimation dye is therefore destroyed, and the sublimation dye is dissolved in the ink and then crystallizes. If the movement of water in the cap can be suppressed, then the above-mentioned nozzle clogging can be effectively suppressed.

1.2.4.4. Water-Soluble Organic Solvent

The ink may contain a water-soluble organic solvent other than the specific organic solvent. When the ink contains the water-soluble organic solvent, the moisture retentivity of the ink is high, discharge stability by an ink jet process is excellent, and the evaporation of water from a recording head during long-term storage can be effectively suppressed. This enables a recovery-from-disuse property and continuous discharge stability to be maintained good even in the case of using a type of dye that is likely to cause nozzle clogging. The water-soluble organic solvent is an alkyl polyol, a nitrogen-containing cyclic compound, a glycol ether, or the like.

Examples of the alkyl polyol include 1,2-butanediol, 1,2-pentanediol, 1,2-hexanediol, 1,2-heptanediol, 1,3-propanediol, 1,3-butanediol, 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 2-ethyl-1,3-hexanediol, 3-methyl-1,5-pentanediol, 2-methylpentane-2,4-diol, diethylene glycol, dipropylene glycol, triethylene glycol, and glycerin. Incidentally, parenthesized values represent normal boiling points. These polyols may be used alone or in combination.

Examples of the nitrogen-containing cyclic compound include lactams such as 2-pyrrolidone and ε-caprolactam.

The glycol ether is preferably a monoalkyl ether of a glycol selected from ethylene glycol, diethylene glycol, triethylene glycol, polyethylene glycol, propylene glycol, dipropylene glycol, tripropylene glycol, polypropylene glycol, and polyoxyethylene polyoxypropylene glycol and is more preferably methyl triglycol (triethylene glycol monomethyl ether), butyl triglycol (triethylene glycol monobutyl ether), butyl diglycol (diethylene glycol monobutyl ether), or dipropylene glycol monopropyl ether. A typical example of the glycol ether is diethylene glycol monobutyl ether. Parenthesized values represent normal boiling points.

The water-soluble organic solvent may be used in combination with one or more water-soluble organic solvents. From the viewpoint of adjusting the viscosity of the ink and the viewpoint of preventing nozzle clogging by a moisturizing effect, the amount of the blended water-soluble organic solvent, which is described in this item, is preferably 0.2% by mass to 30% by mass of the total amount of the ink in total, more preferably 0.4% by mass to 20% by mass, further more preferably 0.5% by mass to 15% by mass, and still further more preferably 0.7% by mass to 10% by mass.

1.2.4.5. Surfactant

The ink may contain a surfactant. The surfactant can be used to adjust or enhance the wettability to recording media (the permeability through fabric and the like) by reducing the surface tension of the ink. The surfactant used may be any of a nonionic surfactant, an anionic surfactant, a cationic surfactant, and an amphoteric surfactant. Furthermore, these may be used in combination.

Among surfactants, an acetylene glycol surfactant, a silicone surfactant, and a fluorinated surfactant can be preferably used.

Examples of the acetylene glycol surfactant include, but are not limited to, Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, DF110D (the above are all trade names, produced by Air Products and Chemicals, Inc.), Olfine B, Y, P, A, STG, SPC, E1004, E1010, PD-001, PD-002W, PD-003, PD-004, PD-005, EXP. 4001, EXP. 4036, EXP. 4051, AF-103, AF-104, AK-02, SK-14, AE-3 (the above are all trade names, produced by Nissin Chemical Industry Co., Ltd.), Acetylenol E00, E00P, E40, and E100 (the above are all trade names, produced by Kawaken Fine Chemicals Co., Ltd.).

The silicone surfactant is not particularly limited and is preferably a polysiloxane compound. The polysiloxane compound is not particularly limited and is, for example, a polyether-modified organosiloxane. Examples of a commercially available product of the polyether-modified organosiloxane include BYK-306, BYK-307, BYK-333, BYK-341, BYK-345, BYK-346, BYK-348, BYK-349 (the above are all trade names, produced by BYK Chemie Japan K.K.), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (the above are all trade names, produced by Shin-Etsu Chemical Co., Ltd.).

The fluorinated surfactant is preferably a fluorine-modified polymer, of which an example is BYK-340 (produced by BYK Chemie Japan K.K.).

In the case of blending surfactants with the ink, the sum of the amounts of the surfactants is preferably 0.01% by mass to 3% by mass of the total amount of the ink, more preferably 0.05% by mass to 2% by mass, further more preferably 0.1% by mass to 1.5% by mass, and particularly preferably 0.2% by mass to 1% by mass.

When the ink contains the surfactants, the stability in the case of discharging the ink from a nozzle tends to increase. The use of appropriate amounts of the surfactants enables the permeability through a recording medium such as fabric to be enhanced in some cases.

1.2.4.6. pH Adjustor

The ink may contain a pH adjustor for the purpose of adjusting the pH. The pH adjustor is not particularly limited and may be an appropriate combination of acid, base, weak acid, and weak base. Examples of acid and base used in such a combination include inorganic acids such as sulfuric acid, hydrochloric acid, and nitric acid; inorganic bases such as lithium hydroxide, sodium hydroxide, potassium hydroxide, dihydrogen potassium phosphate, hydrogen disodium phosphate, potassium carbonate, sodium carbonate, hydrogen sodium carbonate, and ammonia; organic bases such as triethanol amine, diethanol amine, monoethanol amine, tripropanol amine, triisopropanol amine, diisopropanol amine, and tris(hydroxymethyl)aminomethane (THAM); and organic acids such as adipic acid, citric acid, succinic acid, lactic acid, Good's buffers including N,N-bis(2-hydroxyethyl)-2-aminoethanesulfonic acid (BES), 4-(2-hydroxyethyl)-1-piperazineethanesulfonic acid (HEPES), morpholinoethanesulfonic acid (MES), carbamoylmethyl iminobisacetic acid (ADA), piperazine-1,4-bis(2-ethanesulfonic acid) (PIPES), N-(2-acetamide)-2-aminoethanesulfonic acid (ACES), cholamine chloride, N-tris(hydroxymethyl)methyl-2-aminoethanesulfonic acid (TES), acetamide glycine, tricine, glycine amide, and bicine, a phosphate buffer solution, a citrate buffer solution, and a tris buffer solution. Furthermore, among these, a tertiary amine such as triethanol amine or triisopropanol amine and a carboxy group-containing organic acid such as adipic acid, citric acid, succinic acid, or lactic acid are preferably contained as a portion or the whole of the pH adjustor because a pH buffering effect can be more stably obtained.

1.2.4.7. Chelating Agent

A chelating agent may be used for the purpose of removing unnecessary ions in the ink. Examples of the chelating agent include ethylenediaminetetraacetic acid and salts thereof (dihydrogen disodium ethylenediaminetetraacetate, ethylenediamine nitrilotriacetate, ethylenediamine hexametaphosphate, ethylenediamine pyrophosphate, and ethylenediamine metaphosphate).

1.2.4.8. Preservative or Fungicide

The ink may contain a preservative or a fungicide. Examples of the preservative or the fungicide include sodium benzoate, sodium pentachlorophenolate, sodium 2-pyridinethiol-1-oxide, sodium sorbate, sodium dehydroacetate, 1,2-dibenzothiazoline-3-on (Proxel CRL, Proxel BDN, Proxel GXL, Proxel XL. 2, Proxel TN, or Proxel LV produced by Zeneca Inc.), and 4-chloro-3-methylphenol (Preventol CMK or the like produced by Bayer AG).

1.2.4.9. Humectant

The ink may contain a humectant. The humectant used is not particularly limited and may be one for use in general ink jet inks. The normal boiling point of the humectant is preferably 180° C. or higher and more preferably 200° C. or higher. The upper limit of the normal boiling point of the humectant is preferably 250° C. or lower and more preferably 230° C. or lower. When the normal boiling point thereof is within the above range, good water retentivity and wettability can be imparted to the ink.

The humectant used may be a highly moisturizing one among the above-mentioned water-soluble organic solvents. Examples of the humectant include polyols such as diethylene glycol, triethylene glycol, tetraethylene glycol, pentamethylene glycol, trimethylene glycol, 2-butene-1,4-diol, 1,4-butanediol, 2-ethyl-1,3-hexanediol, 2-methyl-2,4-pentanediol, tripropylene glycol, isobutylene glycol, glycerin, diglycerin, meso-erythritol, pentaerythritol, and dipentaerythritol; lactams such as 2-pyrrolidone and ε-caprolactam; urea derivatives such as ethylene urea and 1,3-dimethylimidazolidinone; monosaccharides such as glucose, mannose, fructose, ribose, xylose, arabinose, galactose, aldonic acid, glucitol (sorbit), maltose, cellobiose, lactose, sucrose, trehalulose, and maltotriose; disaccharides; oligosaccharides; polysaccharides; derivatives of these saccharides; and betaines such as glycine and trimethylglycine.

In the case of blending the humectant with the ink, the amount of the blended humectant is preferably 0.2% by mass to 30% by mass of the total amount of the ink, more preferably 0.4% by mass to 20% by mass, further more preferably 0.5% by mass to 15% by mass, and still further more preferably 0.7% by mass to 10% by mass.

1.2.4.10. Others

The ink may further contain, for example, an additive, such as a rust preventive, an oxidation inhibitor, an ultraviolet absorber, an oxygen absorber, or a dissolution aid, usually usable in ink for ink jet as a component other than the above.

1.3. Action Effects

As described above, the ink jet recording apparatus 1 includes the discharge head 3, which includes the nozzles 16 discharging the ink to a recording medium, and the cap 2, which can cover the nozzles 16 of the discharge head 3 and includes no ink absorber. The ink contains water, the colorant, and the organic compound, which is solid at 25.0° C. and has an octanol/water distribution coefficient of 0.0 or less.

The ink jet recording apparatus 1 includes no ink absorber and therefore has advantages that manufacturing costs can be reduced and each row of the nozzles 16 can be capped. The ink contains water, the colorant, and the organic compound, which is solid at 25.0° C. and has an octanol/water distribution coefficient of 0.0 or less. Therefore, even if the ink dripping from the nozzles 16 during capping sticks to the inside of the cap 2, the movement of water from the ink in the nozzles 16 to the dry ink is suppressed; hence, discharge failure is unlikely to occur.

2. Examples and Comparative Examples

The present disclosure is further below in detail with reference to examples and comparative examples. The present disclosure is not limited to the examples and the comparative examples. Hereinafter, "parts" and "%" are on a mass basis unless otherwise specified.

2.1. Preparation of Inks

Components were put in a vessel so as to give a composition shown in the table, were mixed for two hours using a magnetic stirrer, and were agitated, followed by filtration using a membrane filter with a pore size of 5 μm, whereby inks according to the examples and comparative examples were obtained. Incidentally, values in the table are in mass percent. Pigment, dye, and dispersion resin in the table each show the amount of solid matter.

TABLE

| | Example | | | | | | | | | | Comparative Example | | | |
|---|---|---|---|---|---|---|---|---|---|---|---|---|---|---|
| (mass percent) | 1 | 2 | 3 | 4 | 5 | 6 | 7 | 8 | 9 | 10 | 1 | 2 | 3 | 4 |
| DB359 | 5.0 | 5.0 | 5.0 | 5.0 | 5.0 | 5.0 | 5.0 | 5.0 | 5.0 | — | 5.0 | 5.0 | 5.0 | 5.0 |
| PB15:3 | — | — | — | — | — | — | — | — | — | 5.0 | — | — | — | — |
| Dye dispersion resin | 5.0 | 5.0 | 5.0 | 5.0 | 10.0 | 10.0 | 5.0 | 5.0 | — | — | 5.0 | 12.0 | 5.0 | 5.0 |
| Pigment dispersion resin | — | — | — | — | — | — | — | — | — | 0.5 | — | — | — | — |
| Naphthalenesulfonic acid | — | — | — | — | — | — | — | — | 5.0 | — | — | — | — | — |
| Propylene glycol | 5.0 | 5.0 | 5.0 | 5.0 | 5.0 | 5.0 | 5.0 | 5.0 | 5.0 | 5.0 | 5.0 | 5.0 | 5.0 | 5.0 |
| Glycerin | 10.0 | 10.0 | 10.0 | 10.0 | 10.0 | 10.0 | 10.0 | 10.0 | 10.0 | — | 10.0 | 10.0 | 17.0 | 10.0 |
| Methyl triglycol | 5.0 | 5.0 | 5.0 | 5.0 | 5.0 | 5.0 | 5.0 | 5.0 | 5.0 | — | 5.0 | 5.0 | 5.0 | 5.0 |
| 1,2-Hexane diol | — | — | — | — | — | — | — | — | — | 5.0 | — | — | — | — |
| Trimethylolpropane | 7.0 | — | — | — | 7.0 | 12.0 | 20.0 | 3.0 | 7.0 | 7.0 | — | — | — | — |
| Polyvinylpyrrolidone | — | 7.0 | — | — | — | — | — | — | — | — | — | — | — | — |
| Urea | — | — | 7.0 | — | — | — | — | — | — | — | — | — | — | — |
| Thiourea | — | — | — | 7.0 | — | — | — | — | — | — | — | — | — | — |
| Dimethyl terephthalate | — | — | — | — | — | — | — | — | — | — | — | — | — | 7.0 |
| Surfactant BYK 348 | 0.5 | 0.5 | 0.5 | 0.5 | 0.5 | 0.5 | 0.5 | 0.5 | 0.5 | 0.5 | 0.5 | 0.5 | 0.5 | 0.5 |
| Pure water | Rest | Rest | Rest | Rest | Rest | Rest | Rest | Rest | Rest | Rest | Rest | Rest | Rest | Rest |
| Smell | A | A | A | A | A | A | A | A | B | A | A | A | A | A |
| Nozzle clogging properties at cap contamination | A | A | B | B | B | A | A | B | A | A | C | C | C | — |

TABLE-continued

| | Example | | | | | | | | | | Comparative Example | | | |
|---|---|---|---|---|---|---|---|---|---|---|---|---|---|---|
| (mass percent) | 1 | 2 | 3 | 4 | 5 | 6 | 7 | 8 | 9 | 10 | 1 | 2 | 3 | 4 |
| Nozzle clogging properties at cap non-contamination | A | B | A | B | A | A | A | B | A | B | B | B | A | — |

In the table, components described without using a compound name are as described below.

DB 359: C.I. Direct Blue 359 (sublimation dye)

PB 15:3: C.I. Pigment Blue 15:3 (pigment)

Dye dispersion resin: Nopcosperse® 6100 (styrenic dispersion resin; produced by San Nopco, Ltd.)

Pigment dispersion resin: Aron® A-6330 (sodium polycarbonate; produced by TOAGOSEI Co., Ltd.)

Methyl triglycol (triethylene glycol monomethyl ether)

Polyvinylpyrrolidone: a viscosity-average molecular weight of 40,000, a K-value of 30

Surfactant BYK 348: polyether siloxane-based (produced by BYK Chemie Japan K.K.)

2.2. Evaluation of Inks

A smell was sensorially evaluated in such a manner that 10 ml of the ink according to each example was poured in a sample bottle with a volume of 50 ml and a tester smelled the sample bottle. Evaluation standards are as described below and the results are listed in the table.

A: Any smell is not at all felt.

B: A slight smell is felt.

C: A smell is felt.

Nozzle clogging properties at cap contamination were evaluated as described below. Onto a cap (including no ink absorber) of a head, 20 mg of the ink according to each example was dripped using a ink jet printer, SureColor SC-F7000 (manufactured by Seiko Epson Corporation), followed by drying for 24 hours in a 40° C. environment. After the ink according to each example was filled in the head and discharge from all nozzles was confirmed by checking the nozzles, the cap (including no ink absorber) was closed and was left at 40° C. for 24 hours, followed by checking the nozzles. Evaluation standards are as described below and the results are listed in the table.

A: All the nozzles discharge.

B: 80% or more of all the nozzles discharge.

C: Only less than 80% of all the nozzles discharge.

Nozzle clogging properties at cap non-contamination were evaluated as described below. After the ink according to each example was filled in a head using a ink jet printer, SureColor SC-F7000 (manufactured by Seiko Epson Corporation), and discharge from all nozzles was confirmed by checking the nozzles, a cap (including no ink absorber) was closed and was left at 40° C. for 24 hours, followed by checking the nozzles. Evaluation standards are as described below and the results are listed in the table.

A: All the nozzles discharge.

B: 80% or more of all the nozzles discharge.

C: Only less than 80% of all the nozzles discharge.

2.2. Evaluation Results

From the results shown in the table, it became clear that, in the case of using the ink according to each example that contained an organic compound (one selected from trimethylolpropane, polyvinylpyrrolidone, urea, and Thiourea) which was solid at 25.0° C. and which had an octanol/water distribution coefficient of 0.0 or less, nozzle clogging properties in the case of using a cap were good.

However, using the ink according to each comparative example that contained no specific organic compound resulted in that nozzle clogging properties at cap contamination were particularly poor. In Comparative Example 4, in which an organic compound (dimethyl terephthalate) which was solid at 25.0° C. and which had an octanol/water distribution coefficient of 2.25 was used, the solubility of dimethyl terephthalate was poor and discharge could not be evaluated. According to Comparative Examples 2 and 3, increasing the amount of resin or glycerin instead of a specific organic compound led to no good results.

Furthermore, according to the examples, as a specific organic compound was contained, increasing the amount of resin, dispersing dye with naphthalenesulfonic acid, and using pigment in a colorant all resulted in that nozzle clogging properties were good. Incidentally, in the case of using naphthalenesulfonic acid, there was a slight smell.

The present disclosure is not limited to the above-mentioned embodiments and various modifications can be made. The present disclosure includes, for example, configurations (for example, configurations identical in function, method, and result or configurations identical in purpose and effect) substantially identical to those described in the embodiments. The present disclosure includes configurations obtained by replacing nonessential portions of the configurations described in the embodiments with others. The present disclosure includes configurations capable of providing the same advantages as those of the configurations described in the embodiments or capable of achieving the same objects as those of the configurations described in the embodiments. Furthermore, the present disclosure includes configurations obtained by adding known techniques to the configurations described in the embodiments.

What is claimed is:

1. An ink jet recording apparatus comprising:

a discharge head including a nozzle discharging ink to a recording medium; and a cap configured to cover the nozzle of the discharge head, wherein the ink contains water, a colorant, a dispersant, glycerin, and an organic compound which is solid at 25.0° C. and which has an octanol/water distribution coefficient of 0.0 or less and the cap does not include an ink absorber.

2. The ink jet recording apparatus according to claim 1, wherein the discharge head is reciprocated in a main scanning direction and the recording medium is conveyed in a sub-scanning direction crossing the main scanning direction, whereby an image is formed on the recording medium, and the area that the recording medium is conveyed per unit time is 15.0 $m^2$/h or more.

3. The ink jet recording apparatus according to claim 1, further comprising a platen, wherein a surface of the platen faces a nozzle-formed surface provided with the nozzle, the recording medium is conveyed between the platen surface and the nozzle-formed surface, and the distance between the platen surface and the nozzle-formed surface is 1.5 mm or more.

4. The ink jet recording apparatus according to claim 1, wherein the organic compound is selected from trimethylolpropane, polyvinylpyrrolidone, urea, and thiourea.

5. The ink jet recording apparatus according to claim 1, wherein the content of the organic compound in the ink is 3.0% by mass to 20.0% by mass with respect to the whole of the ink.

6. The ink jet recording apparatus according to claim 1, wherein the ink further contains resin except the organic compound.

7. The ink jet recording apparatus according to claim 6, wherein the amount of the organic compound contained in the ink is larger than the amount of the resin contained in the ink.

8. The ink jet recording apparatus according to claim 7, wherein the amount of the organic compound contained in the ink is larger than the sum of the amounts of the colorant and resin contained in the ink.

9. The ink jet recording apparatus according to claim 1, further comprising a pressurized cleaning mechanism cleaning the nozzle.

* * * * *